US012330750B2

(12) United States Patent
Cialdella

(10) Patent No.: US 12,330,750 B2
(45) Date of Patent: Jun. 17, 2025

(54) FAIL-SAFE SEALING SYSTEMS FOR WATERCRAFT INCLUDING SELF-BAILING DRAIN PLUGS AND SEALING CAPS SECURABLE TO THE OUTBOARD SIDE OF THE SELF-BAILING DRAIN PLUGS

(71) Applicant: Christopher Cialdella, Warren, NJ (US)

(72) Inventor: Christopher Cialdella, Warren, NJ (US)

( * ) Notice: Subject to any disclaimer, the term of this patent is extended or adjusted under 35 U.S.C. 154(b) by 556 days.

(21) Appl. No.: 17/710,346

(22) Filed: Mar. 31, 2022

(65) Prior Publication Data

US 2023/0312056 A1 Oct. 5, 2023

(51) Int. Cl.
*B63B 13/00* (2006.01)

(52) U.S. Cl.
CPC ..... *B63B 13/00* (2013.01)

(58) Field of Classification Search
CPC ..... B63B 13/00
USPC ..... 114/182, 197, 198
See application file for complete search history.

(56) References Cited

U.S. PATENT DOCUMENTS 6,237,639 B1 * 5/2001 Jougla ..... B63B 13/00 114/197
6,357,376 B1 * 3/2002 Purio ..... B63B 13/00 114/197
6,634,312 B2 * 10/2003 Warner ..... B63B 13/02 114/197
7,316,195 B2 * 1/2008 DeHart ..... B63B 13/00 114/197

* cited by examiner

*Primary Examiner* — Lars A Olson
(74) *Attorney, Agent, or Firm* — Charney IP Law LLC

(57) ABSTRACT

A fail-safe sealing system for a watercraft includes a self-bailing drain plug having an outer wall with a proximal end having a proximal opening, a distal end having a distal opening, and a fluid conduit that extends from the proximal opening to the distal opening. The sealing system includes a check valve including a ball disposed within the fluid conduit and being surrounded by the outer wall, and a ball retaining pin extending between opposite lateral sides of the outer wall adjacent the proximal opening for preventing the ball from passing through the proximal opening. The sealing system includes a sealing cap having a bayonet-style locking assembly that locks onto the ball retaining pin for securing the sealing cap to the proximal end of the outer wall for forming a water-tight seal with the proximal end of the outer wall of the self-bailing drain plug.

18 Claims, 15 Drawing Sheets

FAIL-SAFE SEALING SYSTEMS FOR WATERCRAFT INCLUDING SELF-BAILING DRAIN PLUGS AND SEALING CAPS SECURABLE TO THE OUTBOARD SIDE OF THE SELF-BAILING DRAIN PLUGS

BACKGROUND OF THE INVENTION

Field of the Invention

The present patent application is generally related to watercraft such as boats and personal water craft, and is more specifically related to systems, devices and methods for draining water that collects inside watercraft.

Description of the Related Art

Water can enter into a boat or a personal watercraft through various pathways and methodologies. If water can find a pathway to flow into a watercraft, it will.

For example, when high waves crash against the hull of a boat, some of the water will spill into the boat. As a result, the boat will take on water even when it is sitting still.

The other main cause of taking on water is a leak, which may result from a leaking hose, a leak around a propeller shaft, or a hole in the hull.

A watercraft has a lower chance of taking on water if the vessel is anchored and located in calm waters when moored.

Thus, watercraft operators must continuously monitor for water collecting inside the vessel and must often take affirmative steps to drain the water from the vessel.

There have been many efforts directed to draining water from watercraft. For example, pumps may be used to pump water from the bilge of a boat.

Moreover, watercraft are often supplied with factory installed drain holes that may be opened for draining water from the vessel.

Drain plugs may be installed in drain holes. The drain plugs may be opened when the operator desires to drain water from the watercraft.

Occasionally, drain plugs fail, which may result in an anchored and unattended watercraft sinking. This problem has been particularly acute with drain plugs that have rubber and/or duck bill valves.

In view of the above-noted deficiencies, there remains a need for fail-safe sealing systems for watercraft including drain plugs that enable water to be drained from watercrafts, but that will not fail when the watercraft are left unattended or stored overnight in the water.

SUMMARY OF THE INVENTION

In one embodiment, a fail-safe sealing system for a watercraft preferably includes a self-bailing drain plug having an outer wall with a proximal end having a proximal opening, a distal end having a distal opening, and a fluid conduit that extends from the proximal opening to the distal opening.

In one embodiment, the fail-safe sealing system includes a check valve including a ball disposed within the fluid conduit and being surrounded by the outer wall, and a ball retaining pin extending between opposite lateral sides of the outer wall adjacent the proximal opening for preventing the ball from passing through the proximal opening.

In one embodiment, the fail-safe sealing system includes a sealing cap having a bayonet-style locking assembly that locks onto the ball retaining pin for securing the sealing cap to the proximal end of the outer wall for forming a water-tight seal with the proximal end of the outer wall of the self-bailing drain plug.

In one embodiment, the proximal end of the outer wall has a proximal face that surrounds the proximal opening, and the sealing cap has a sealing washer projecting from a washer groove formed therein that is configured to engage the proximal face for forming the water-tight seal with the proximal end of the outer wall.

In one embodiment, the sealing cap may be used as an installation tool for installing and/or removing the self-bailing drain plug from a drain hole and/or drain hole flange of a watercraft.

In one embodiment, the distal end of the outer wall of the self-bailing drain plug includes external threads that are configured to mesh with internal threads of a drain hole of a watercraft.

In one embodiment, the fluid conduit has a smaller diameter section adjacent the distal end of the outer wall that defines a ball seating surface that is adapted to engage an outer surface of the ball.

In one embodiment, the fail-safe sealing system includes a strainer covering the distal opening of the self-bailing drain plug.

In one embodiment, the ball retaining pin in made of stainless steel.

In one embodiment, the ball is made of an acetal homopolymer, such as that sold under the trademark DELRIN® by DuPont. In one embodiment, the ball is made from an acetal homopolymer such as DELRIN® because the acetal homopolymer material will not dissolve from fuel or oil and will not grow bacteria or barnacles.

In one embodiment, the sealing cap preferably includes a sealing cap base having a proximal face and a distal face, a handle projecting from the proximal face of the sealing cap base, a washer groove formed in the distal face of the sealing cap base, and a sealing washer disposed within the washer groove, the sealing washer having a thickness that is greater than a depth of the washer groove so that a portion of the sealing washer extends distally beyond the distal face of the sealing cap base.

In one embodiment, the bayonet-style locking assembly includes first and second locking tabs projecting distally from the sealing cap base and distally beyond the distal face of the sealing cap base.

In one embodiment, each locking tab may have a locking slot that is configured to receive the ball retaining pin for securing the sealing cap to the proximal end of the self-bailing drain plug.

In one embodiment, each locking slot preferably has an open end and a closed end, whereby the ball retaining pin is configured for being captured within the open ends of the respective locking slots of the first and second locking tabs.

In one embodiment, the sealing cap is rotatable relative to a longitudinal axis of the self-bailing drain plug for securing the sealing cap to the proximal end of the self-bailing drain plug.

In one embodiment, during initial rotation of the sealing cap, the ball retaining pin is located at the open ends of the respective locking slots and during a later rotation of the sealing cap, the ball retaining pin is located at the closed ends of the respective locking slots.

In one embodiment, the ball retaining pin has an outer diameter and the locking slots have a height that is less than the outer diameter of the ball retaining pin.

In one embodiment, the open ends of the locking slots of the first and second locking tabs face in opposite directions for enabling the sealing cap to be twisted as it is secured to the proximal end of the self-bailing drain plug.

In one embodiment, the handle may have an opening formed therein.

In one embodiment, the fail-safe sealing system may include a flotation device secured to the handle via the opening in the handle.

These and other preferred embodiments of the present patent application will be described in more detail herein.

DETAILED DESCRIPTION OF PREFERRED EMBODIMENTS

Figure 1A:
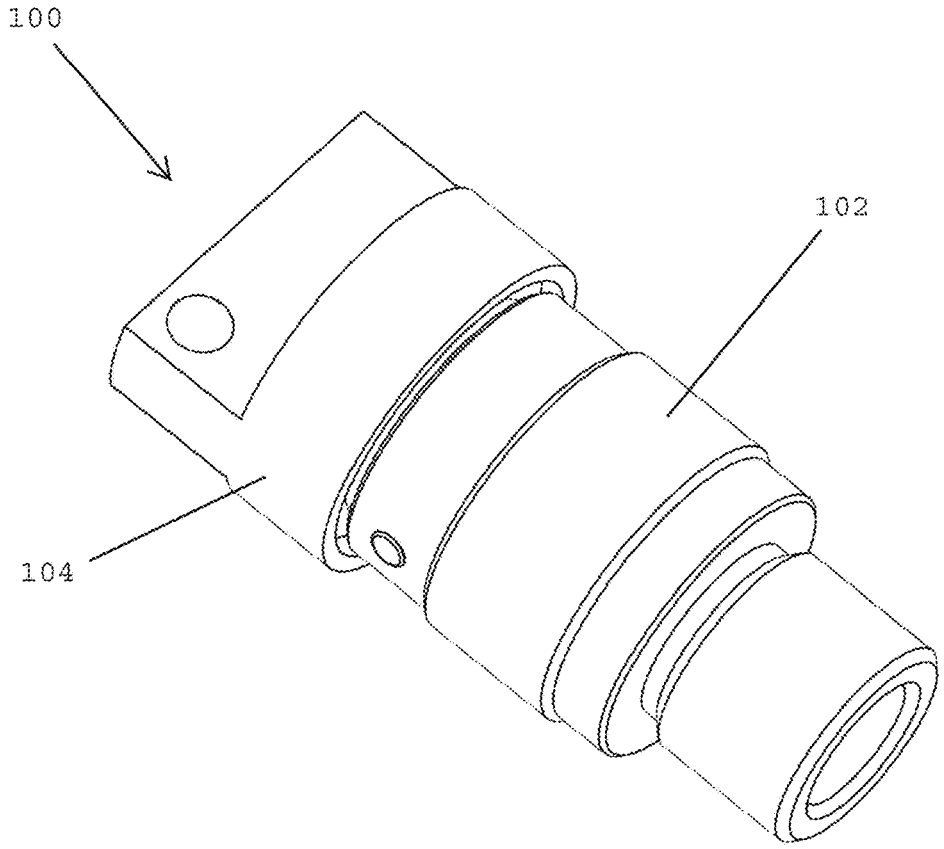
FIG. 1A is a perspective view of a fail-safe sealing system for watercrafts including a self-bailing drain plug having a ball check valve and a sealing cap that is secured to a proximal end of the self-bailing drain plug, in accordance with one embodiment of the present patent application.
Figure 1B:
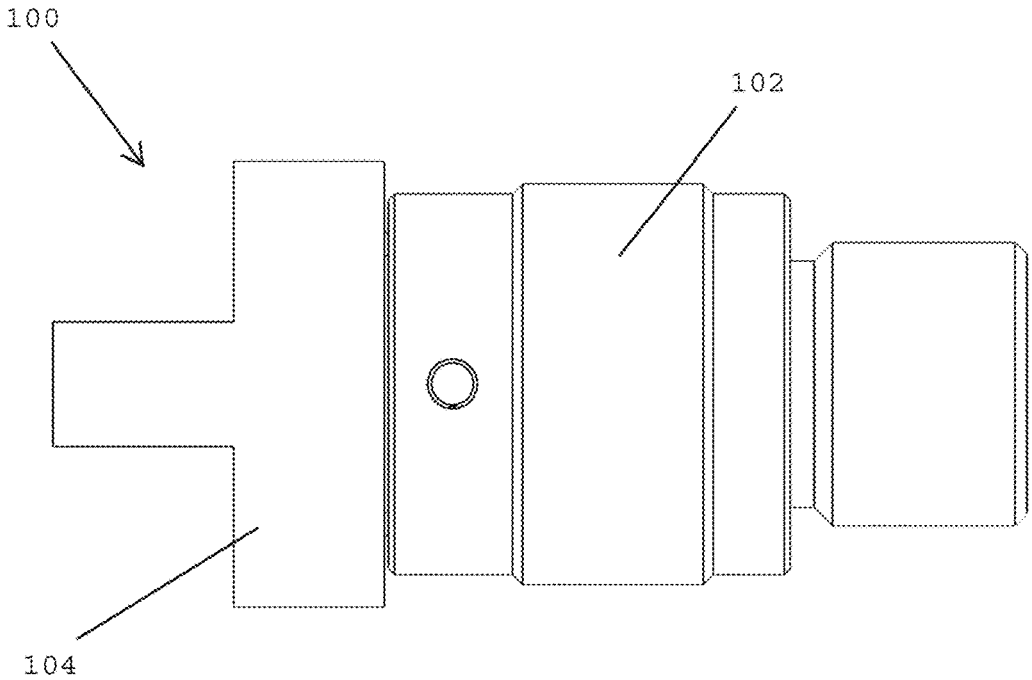
FIG. 1B is a side elevation view of the fail-safe sealing system shown in FIG. 1A.

Referring to FIGS. 1A and 1B, in one embodiment, a fail-safe sealing system 100 for sealing a bilge water drainage hole of a watercraft, such as a boat or a personal watercraft, preferably includes a self-bailing drain plug 102 and a sealing cap 104 that is preferably configured for locking onto the proximal end of the self-bailing drain plug 102 for in-water storage. For example, the sealing cap 104 may be secured to the self-bailing drain plug for long-term or overnight storage of a boat or a personal watercraft in the water (e.g., lake water; bay water; ocean water).

In one embodiment, the sealing cap 104 may be used as an installation tool for installing and/or removing the self-bailing drain plug 102 from a drain hole and/or drain hole flange of a watercraft (e.g., a boat; a personal watercraft).

Figure 2A:
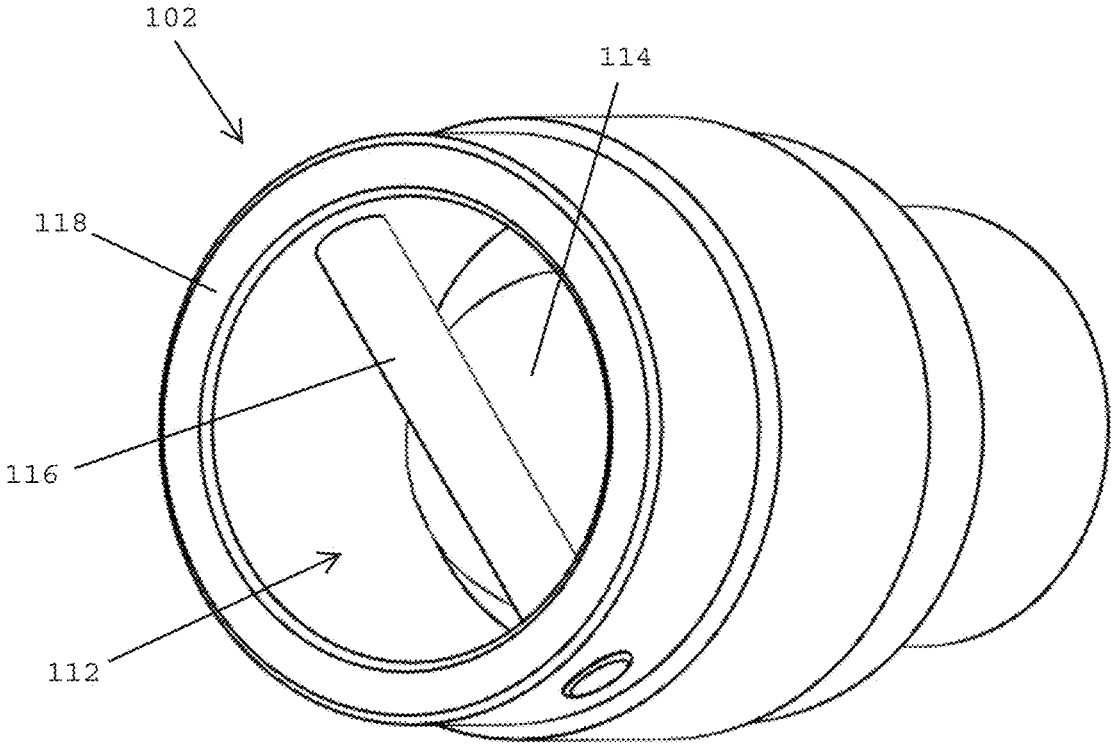
FIG. 2A is a perspective view of a proximal end of the self-bailing drain plug shown in FIG. 1A.
Figure 2B:
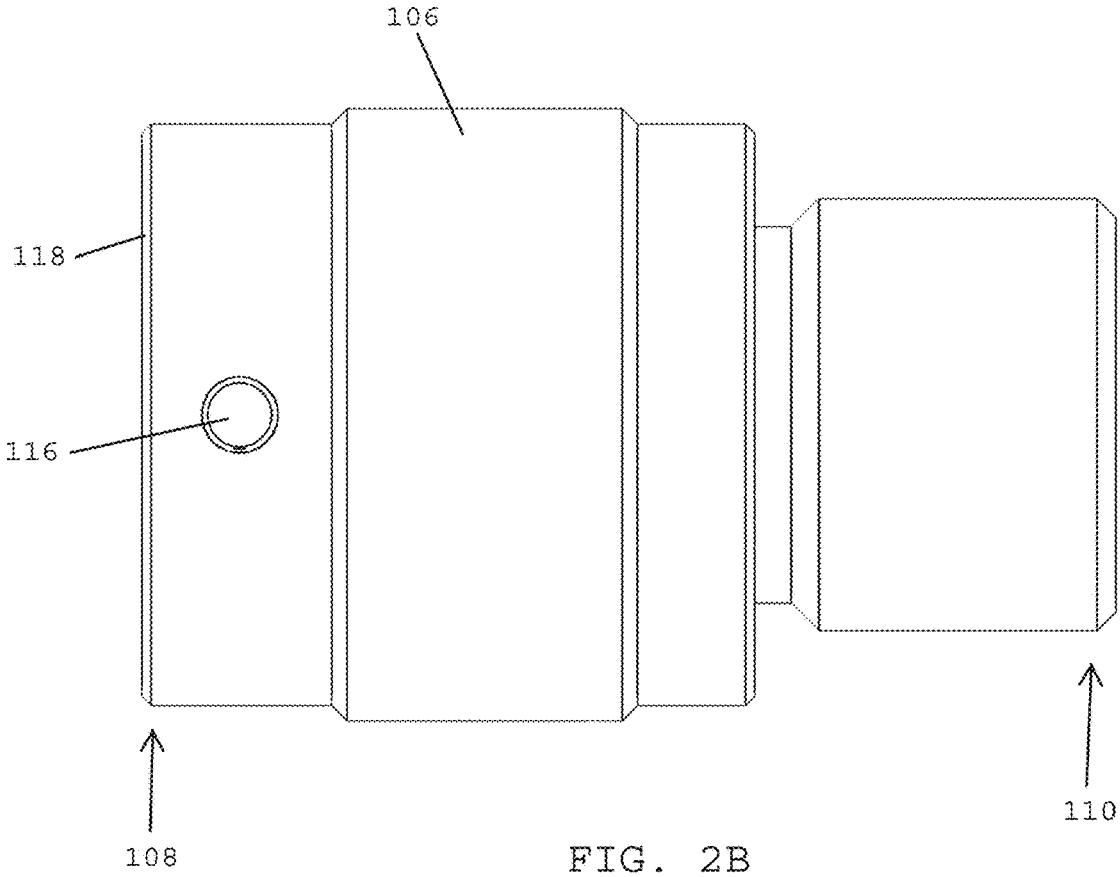
FIG. 2B is a side elevation view of the self-bailing drain plug shown in FIG. 2A.

Referring to FIGS. 2A and 2B, in one embodiment, the self-bailing drain plug 102 preferably includes an outer wall 106 that extends from a proximal end 108 to a distal end 110 of the self-bailing drain plug. The outer wall 106 may have a tube shape with a conduit 112 that extends along the length of the self-bailing drain plug 102 from the proximal end 108 to the distal end 110 thereof. In one embodiment, the self-bailing drain plug 102 preferably includes a ball 114 that is disposed within the conduit 112 and that is free to move within the conduit between open and closed positions. The self-bailing drain plug 102 desirably includes a ball retaining pin 116 that is located adjacent a drainage opening located at the proximal end 108 (i.e., the outboard end) of the outer wall 106 of the self-bailing drain plug.

In one embodiment, the self-bailing drain plug 102 preferably includes a proximal face 118 having a ring or circular shape that extends around the outer perimeter of the drainage opening located at the proximal end 108 of the self-bailing drain plug 102. As will be described in more detail herein, the proximal face 118 of the self-bailing drain plug is configured to engage a sealing washer (e.g., a VITON® washer) of the sealing cap 104 (FIGS. 1A and 1B) for forming a watertight seal between a distal face of the sealing cap and the proximal face 118 of the self-bailing drain plug 102.

Figure 3:
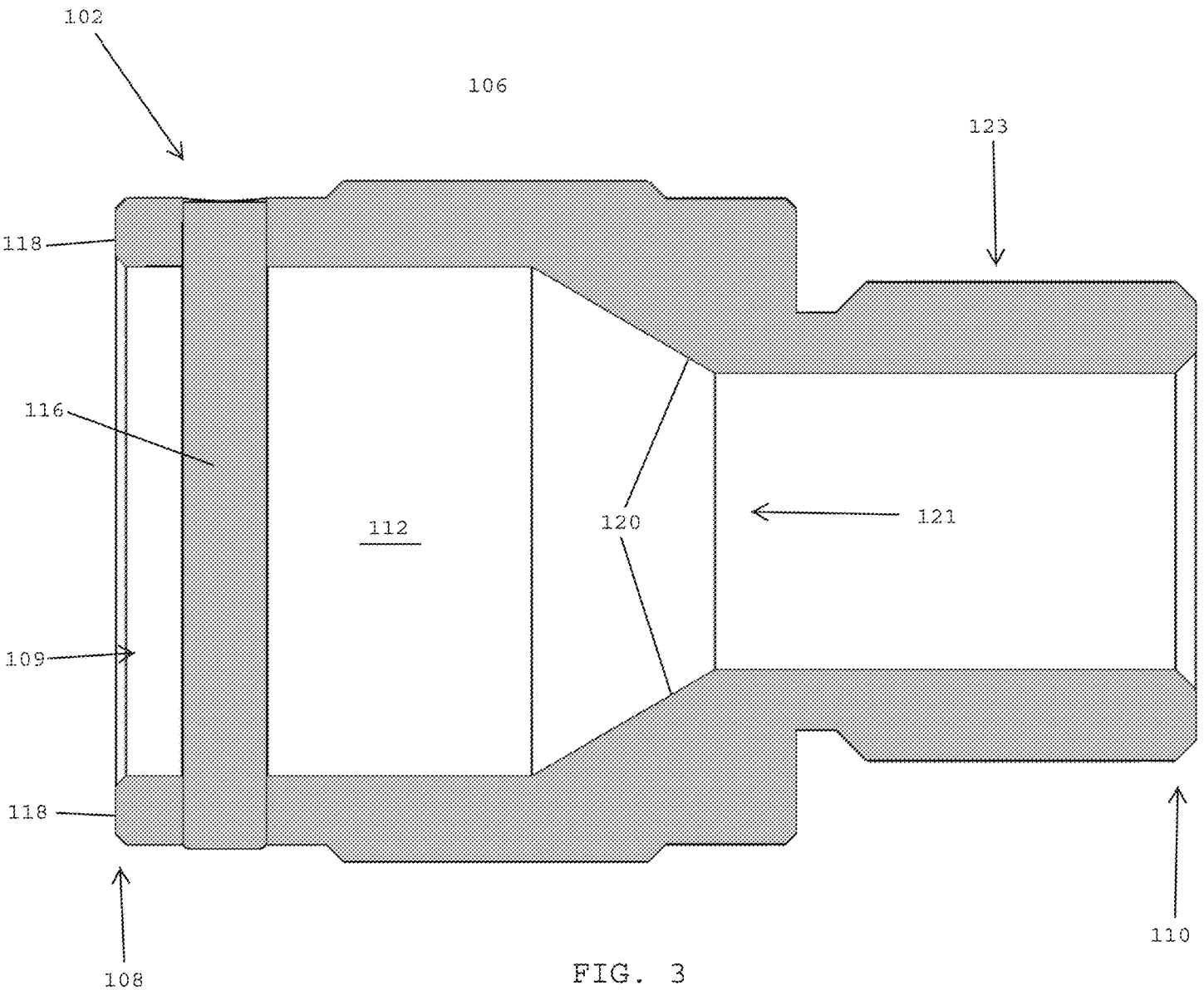
FIG. 3 is a cross-sectional view of the self-bailing drain plug shown in FIGS. 2A and 2B with a ball removed for simplifying the illustration of the internal structure of the self-bailing drain plug, in accordance with one embodiment of the present patent application.

Referring to FIG. 3, in one embodiment, the self-bailing drain plug 102 preferably includes the outer wall 106 (e.g., a tube-shaped outer wall) that extends from the proximal end 108 to the distal end 110 of the self-bailing drain plug 102. The centrally located conduit 112 extends along the length of the self-bailing drain plug 102 from the proximal end 108 to the distal end 110 thereof. The ball retaining pin 116 extends across the water drainage opening located at the proximal end 108 of the self-bailing drain plug 102. The proximal face 118 extends around the outer perimeter of the self-bailing drain plug 102 at the proximal end 108 thereof.

In one embodiment, the self-bailing drain plug 102 preferably includes a ball seating surface 120 that surrounds the conduit 112. The ball seating surface 120 desirably tapers inwardly to define a restricted opening 121 that has a diameter that is smaller than the outer diameter of the ball 114 (FIG. 2A). The ball seating surface 120 is preferably adapted to seat the ball 114 (FIG. 2A) when the self-bailing drain plug 102 is in a closed position for preventing water from passing through the conduit 112 into the water drainage hole of a water going vessel.

In one embodiment, the distal end of the self-bailing drain plug 102 preferably includes a distal connector 123 that is configured for being inserted into the water drainage hole of the watercraft for forming a water-tight seal between the distal end of the self-bailing drain plug 102 and the water drainage hole of the watercraft. In one embodiment, the distal connector 123 may have external threads that engage internal threads associated with a water drainage hole of a watercraft or a flange that is secured around the water drainage hole of the watercraft.

Figure 4:
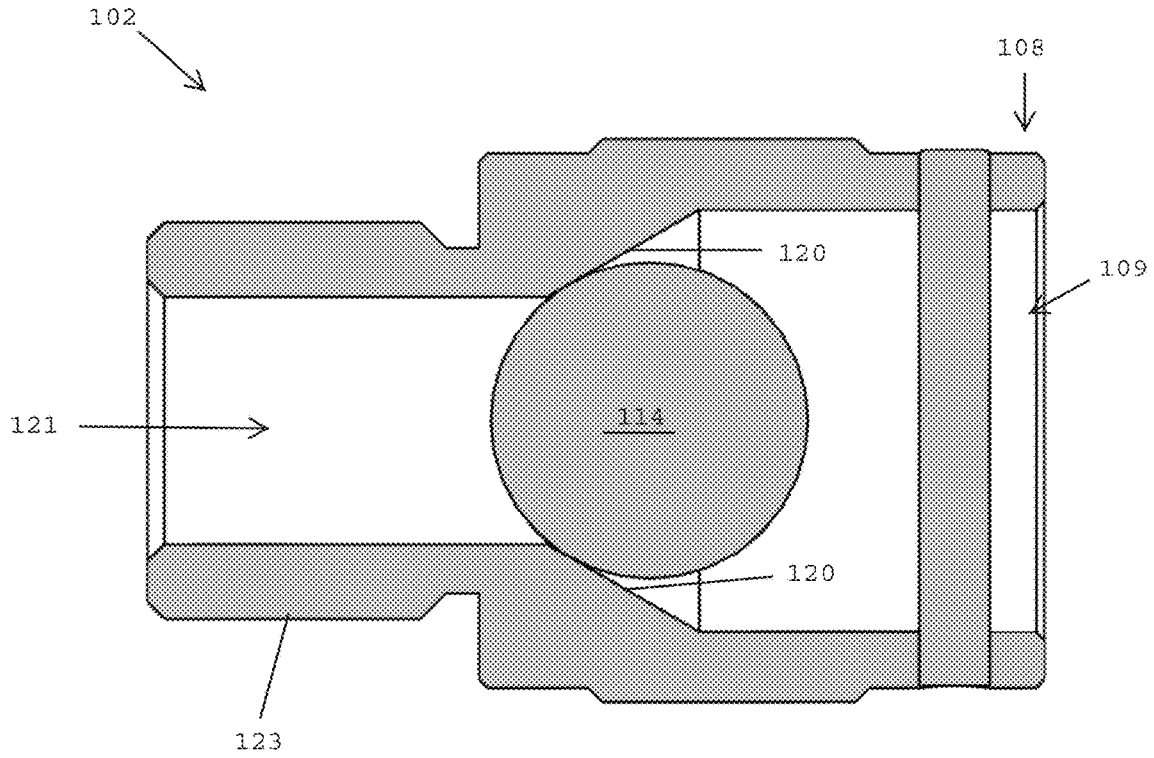
FIG. 4 shows a cross-sectional view of a self-bailing drain plug with a ball disposed inside a conduit of the self-bailing drain plug, the ball being in a closed position for preventing water from flowing into a drain hole of a watercraft, in accordance with one embodiment of the present patent application.
Figure 5:
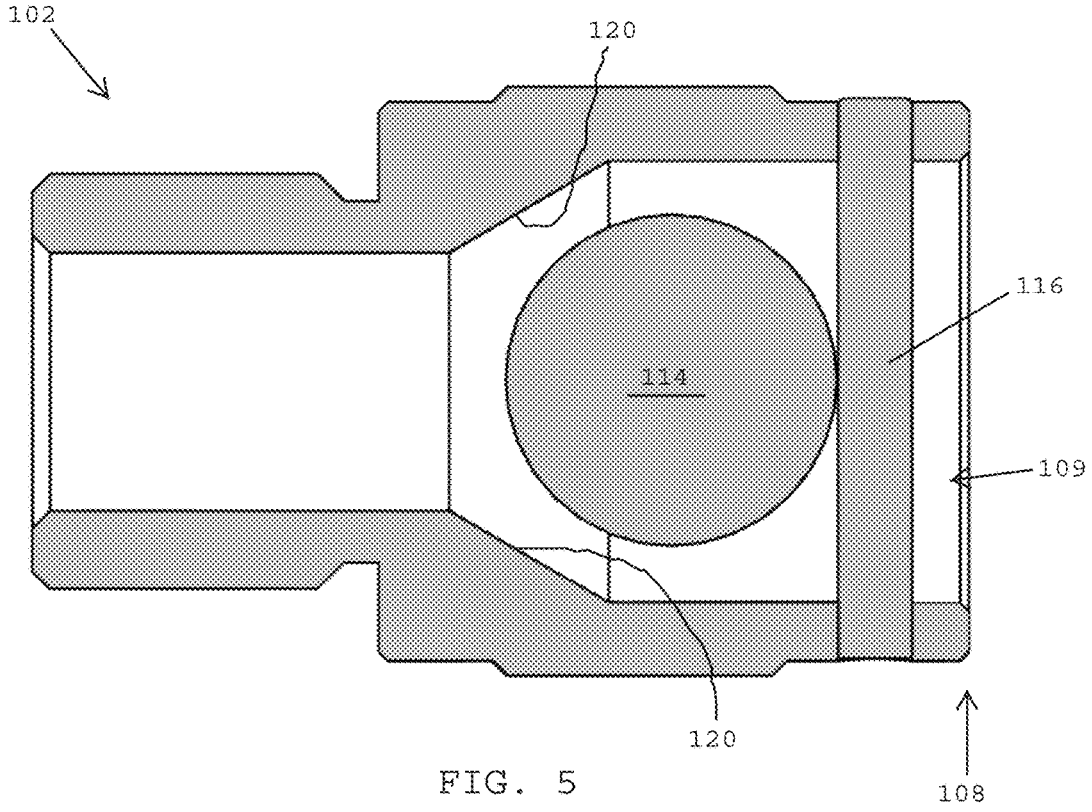
FIG. 5 is a cross-sectional view of the self-bailing drain plug of FIG. 4 with the ball in an open position for allowing water to be drained from a watercraft, in accordance with one embodiment of the present patent application.
Figure 6:
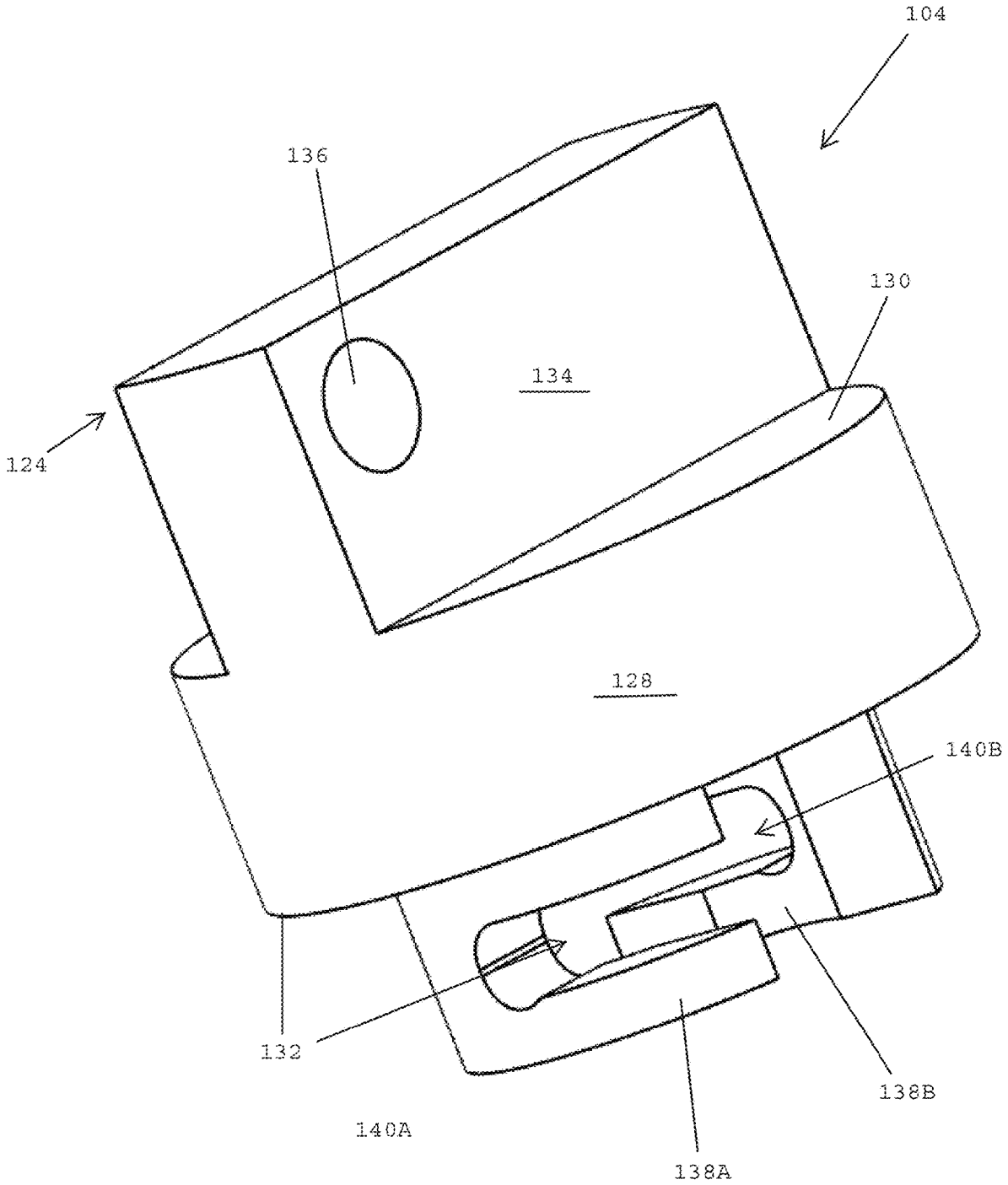
FIG. 6 is a perspective of the sealing cap shown in FIGS. 1A and 1B, the sealing cap having a bayonet-style locking structure for being secured to a proximal end of the self-bailing drain plug shown in FIGS. 2A-2B and 3.

Referring to FIGS. 4 and 5, in one embodiment, the ball 114 of the self-bailing drain plug 102 is preferably moveable between a closed position, which is shown in FIG. 4, and an open position, which is shown in FIG. 5. In one embodiment, the ball 114 closes the self-bailing drain plug 102 when the water pressure outside the vessel is greater than the water pressure inside the vessel. Once the vessel starts moving forward, the ball 114 moves toward the proximal end 108 of the self-bailing drain plug for allowing any water that is present in the vessel to flow out of the drainage opening 109 on the outboard side of the vessel. When the vessel stops moving forward, the ball 114 again seals the self-bailing drain plug 102.

Referring to FIG. 4, in one embodiment, the distal connector of the self-bailing drain plug 102 is configured for being inserted into a water drainage hole of a boat or personal watercraft, whereupon the drainage opening 109 located at the proximal end of the self-bailing drain plug is located outside the watercraft (e.g., outboard). In FIG. 4, the water level outside the boat or personal watercraft is higher than the water level inside the boat or personal watercraft so that the differential water pressure forces the ball 114 against the valve seating surface 120, which prevents any water from flowing into the restricted opening 121, which, in turn, prevents the water from flowing into the boat or personal watercraft.

Referring to FIG. 5, in one embodiment, when the boat or personal watercraft is lifted out of the water, any water present in the hull of the boat will drain out of the water drainage hole of the boat, which forces the ball 114 against the ball retaining pin 116 located adjacent the drainage opening 109 located at the proximal end 108 of the self-bailing drain plug 102. The ball 114 is spaced away from the ball seating surface 120 so that the water (e.g., bilge water) that has collected within the boat or personal water craft may be dispensed via the drainage opening 109 at the proximal end 108 of the self-bailing drain plug 102.

In some instances, operators of watercraft may wish to leave their vessels (e.g., boat; personal water craft) in the water for long-term or overnight storage. Some boat operators lack confidence that a drain plug or drainage system (e.g., a duckbill valve drainage system) will be one hundred percent (100%) reliable for preventing water from leaking into and/or entering into the vessel. In some instances, water drainage systems have failed, which results in water entering into the vessel and ultimately sinking the vessel. Thus, in order to provide additional security and confidence for boat and personal water craft operators, the fail-safe sealing systems disclosed herein preferably include a sealing cap 104 that may be locked onto the ball retaining pin 116 (FIG. 2A) located adjacent the drainage opening 109 located at the proximal end of the self-bailing drain plug. In one embodiment, the locking cap 104 desirably includes a bayonet-style locking assembly 122 that projects from a distal end of the sealing cap 104 and that is configured for locking onto the ball retaining pin.

In one embodiment, the sealing cap 104 preferably includes a proximal end 124, and a distal end 126. In one embodiment, the sealing cap 104 preferably includes a sealing cap base 128 having a proximal face 130 and a distal face 132. The sealing cap 104 desirably includes a handle 134 that projects from the proximal face 130 of the base 128. The sealing cap handle 134 may include an opening 136 passing therethrough that may be utilized for securing a flotation device to the sealing cap 104 as will be described in more detail herein.

In one embodiment, the bayonet-style locking assembly 122 of the sealing cap 104 preferably includes first and second locking tabs 138A, 138B that preferably project distally beyond the distal face 132 of the sealing cap base 128. Each of the sealing cap locking tabs 138A, 138B preferably has a respective locking slot 140A, 140B formed therein that is adapted to receive the ball retaining pin 116 (FIG. 3) for locking the sealing cap to the proximal end of the self-bailing drain plug. In one embodiment, the ball retaining pin 116 is preferably configured for being captured within the locking slots 140A, 140B as the sealing cap 104 is rotated for locking the sealing cap onto the ball retaining pin adjacent the proximal end of the self-bailing drain plug 102 (FIG. 2A).

Figure 7A:
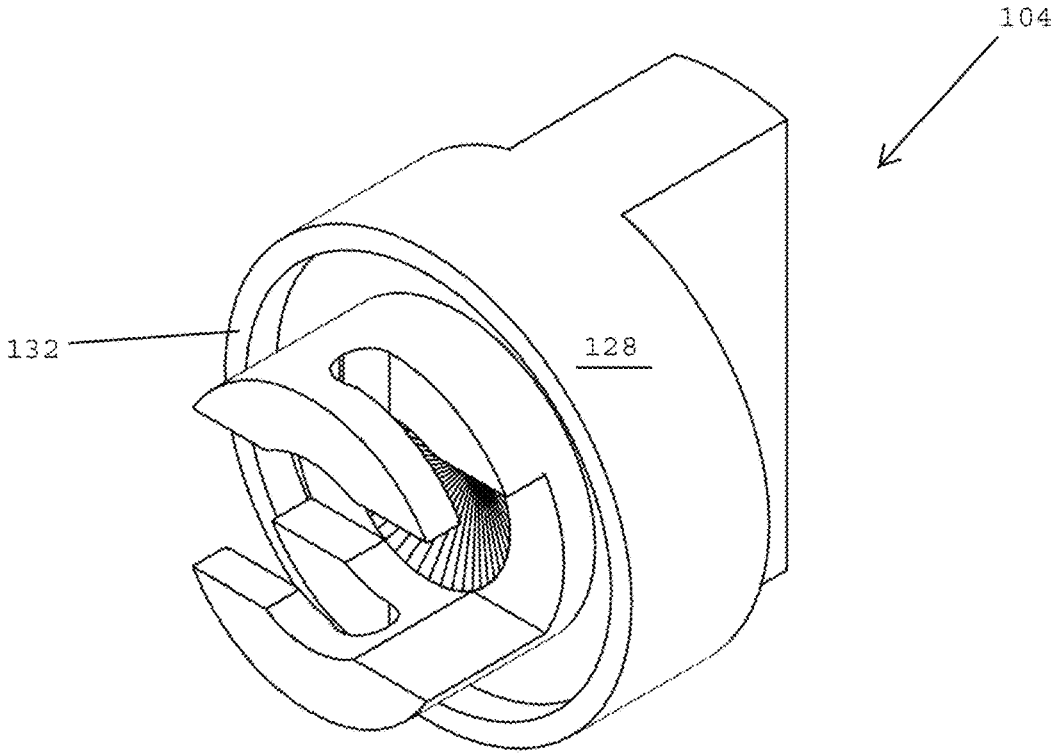
FIG. 7A is a perspective view of a distal end of the sealing cap shown in FIG. 6.
Figure 7B:
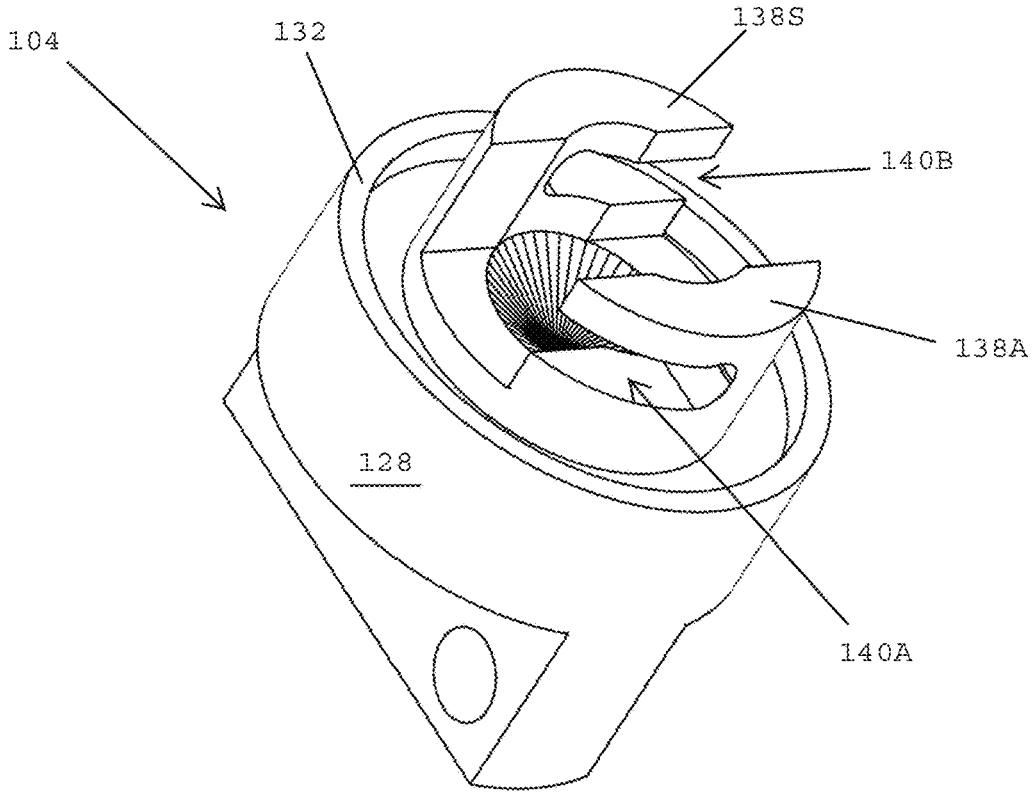
FIG. 7B is another perspective view of the distal end of the sealing cap shown in FIG. 6.

Referring to FIGS. 7A and 7B, in one embodiment, the sealing cap 104 preferably includes the sealing cap base 128 having a distal face 132. The bayonet-style locking assembly 122 including the first and second locking tabs 138A, 138B desirably project distally beyond the distal face 132 of the sealing cap base 128. Each of the sealing cap locking tabs 138A, 138B desirably includes a respective locking slot 140A, 140B formed therein. The respective locking slots 140A, 140B are configured to lock onto the ball retaining pin 116 (FIG. 2A) located at the proximal end of the self-bailing drain plug 102 for providing a fail-safe seal at the proximal end (e.g., outboard side) of the self-bailing drain plug.

Figure 8:
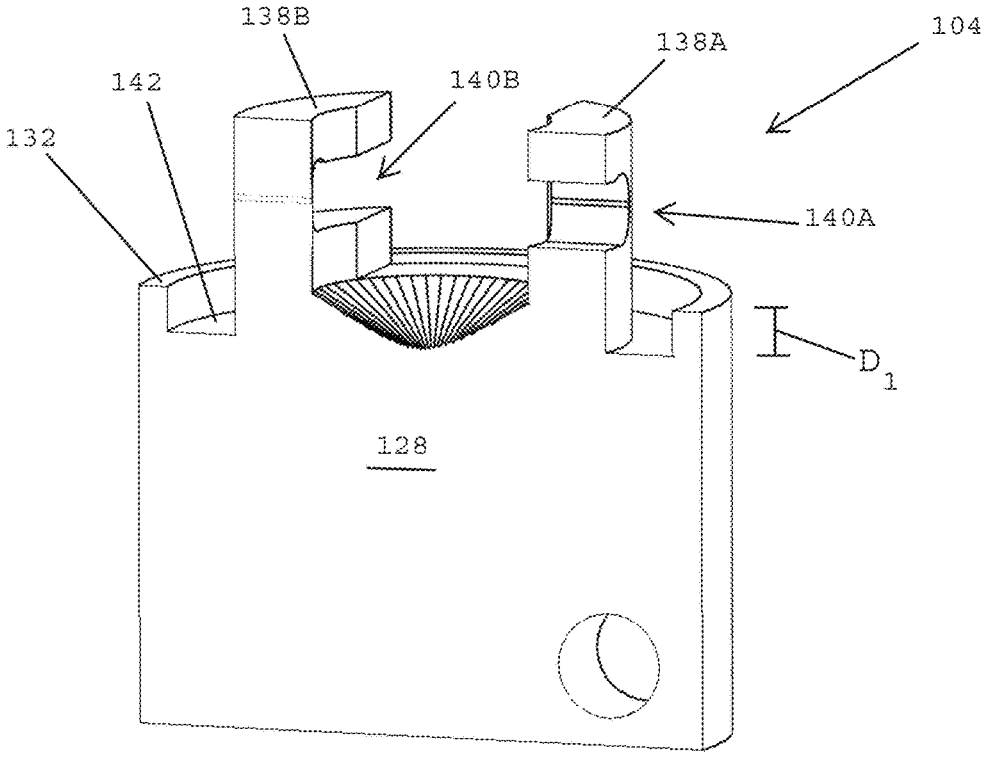
FIG. 8 is a cross-sectional view of the sealing cap shown in FIGS. 6 and 7A-7B.

Referring to FIG. 8, in one embodiment, the sealing cap 104 preferably includes a washer groove 142 that is formed in the distal face 132 of the sealing cap base 128. The washer groove 142 preferably has an annular configuration, which extends around the first and second locking tabs 138A, 138B that project from the distal end of the sealing cap 104. The first and second locking tabs 138A, 138B have respective locking slots 140A, 140B that are configured to receive and lock onto the ball retaining pin 116 (FIG. 2A) located at the proximal end of the self-bailing drain plug.

In one embodiment, the washer groove 142 preferably defines a depth $D_1$ that extends between the floor of the washer groove 142 and the distal face 132 of the sealing cap base 128 of the sealing cap 104.

Figure 9:
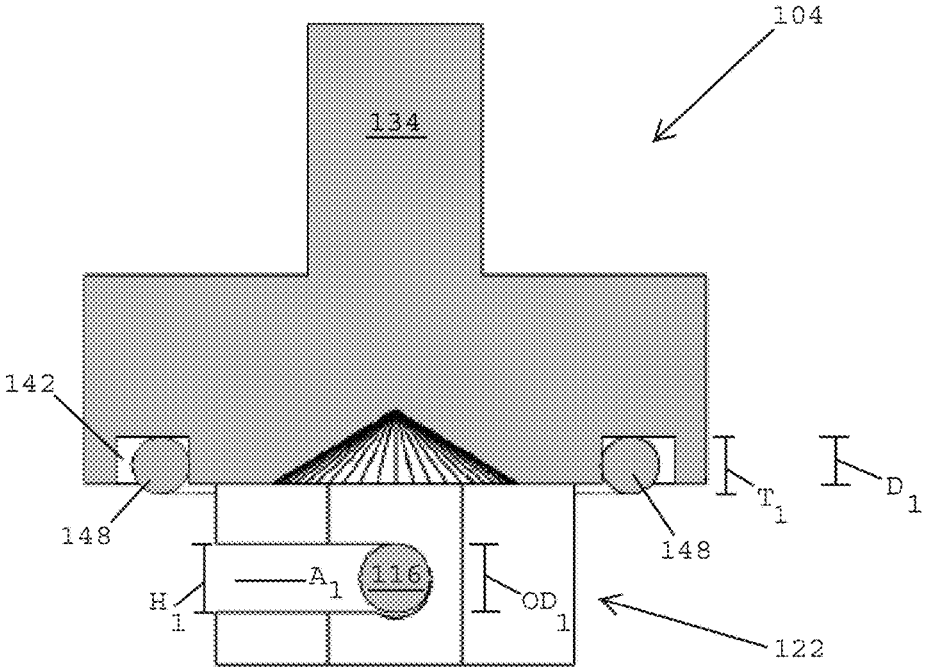
FIG. 9 is another cross-sectional view of the sealing cap shown in FIGS. 6 and 7A-7B.

Referring to FIG. 9, in one embodiment, the washer groove 142 is formed in the distal face 132 of the sealing cap base 128 of the sealing cap 104. A sealing washer 148 is disposed within the washer groove 142. The sealing washer has a thickness $T_1$ that is greater than the depth $D_1$ of the washer groove 142 so that the sealing washer protrudes distally beyond the distal face 132 of the sealing cap base 128.

In one embodiment, the handle 134 of the sealing cap 104 projects proximally from the proximal face 130 of the sealing cap base. The handle 134 may be grasped by the fingers of a watercraft operator for securing (e.g., screwing) the sealing cap 104 onto the ball retaining pin 116 located at the proximal end of the self-bailing drain plug. The second locking tab 138B of the bayonet-style locking assembly 122 preferably has a second locking slot 140B formed therein. The closed end 144 of the locking slot 140B preferably has a circular opening 146 formed therein that is offset relative to the longitudinal axis $A_1$ of the second locking slot 140B, which enhances the locking force generated between the sealing cap and the ball retaining pin 116 (FIG. 2A) when a sealing cap is locked onto the proximal end of the self-bailing drain plug. The second locking slot 140B has a height $H_1$ that is less than the cross-section diameter $OD_1$ of the ball retaining pin 116, which requires the second locking tab 138B to flex outwardly to receive the ball retaining pin 116 as the ball retaining pin is advanced toward the closed end 144 of the second locking slot 140B, which further enhances the locking forces generated between the sealing cap 104 and the proximal end of the self-bailing drain plug.

Figure 10A:
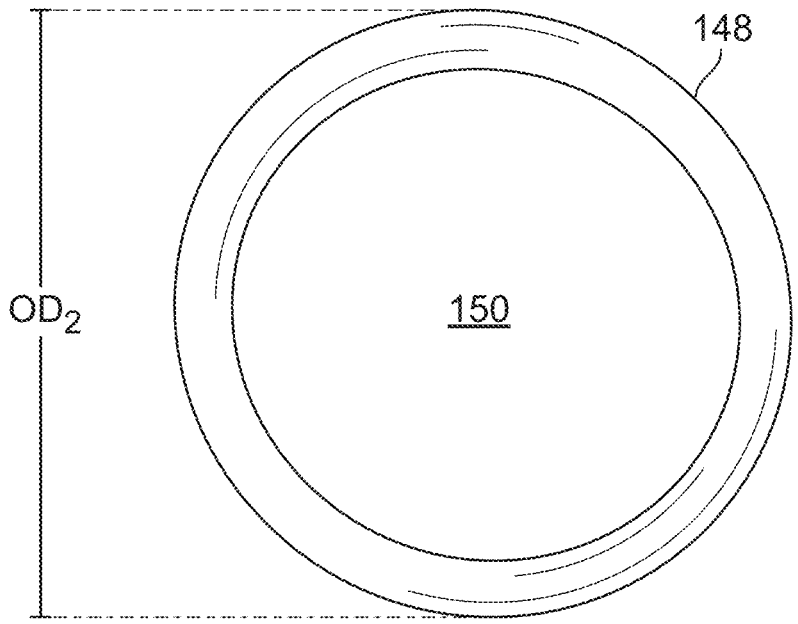
FIG. 10A is a front elevation view of a sealing washer that is assembled with the sealing cap shown in FIGS. 6 and 7A-7B.
Figure 10B:
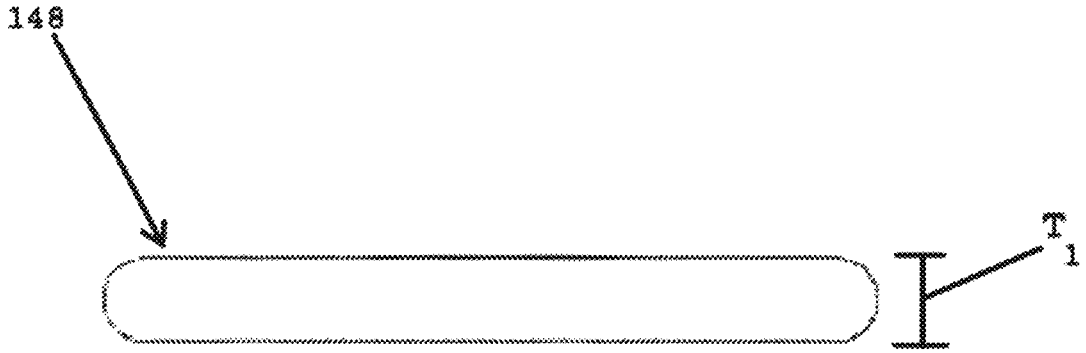
FIG. 10B is a side view of the sealing washer shown in FIG. 10A.

Referring to FIGS. 10A and 10B, in one embodiment, the washer groove 142 formed in the sealing cap 104 (FIGS. 8 and 9) desirably includes a sealing washer 148 (e.g., a sealing washer made of VITON® material) having a ring shape with a central opening 150. In one embodiment, the sealing washer 148 is preferably inserted into the washer groove 142 (FIG. 9). The sealing washer 148 preferably has a thickness $T_1$ (FIG. 10B) that is greater than the depth $D_1$ of the washer groove 142 so that when the sealing washer is inserted into the washer groove it has a portion that extends distally beyond the distal face 132 of the base 128 of the sealing cap 104.

In one embodiment, the sealing washer 148 has an outer diameter $OD_2$ that preferably matches the diameter of the proximal face 118 of the self-bailing drain plug 102 (FIG. 2A) so that the sealing washer 148 abuts against the proximal face 118 of the self-bailing drain plug when the locking cap is secured to the proximal end of the self-bailing drain plug for forming a water-tight seal between the locking cap and the self-bailing drain plug.

Figure 11:
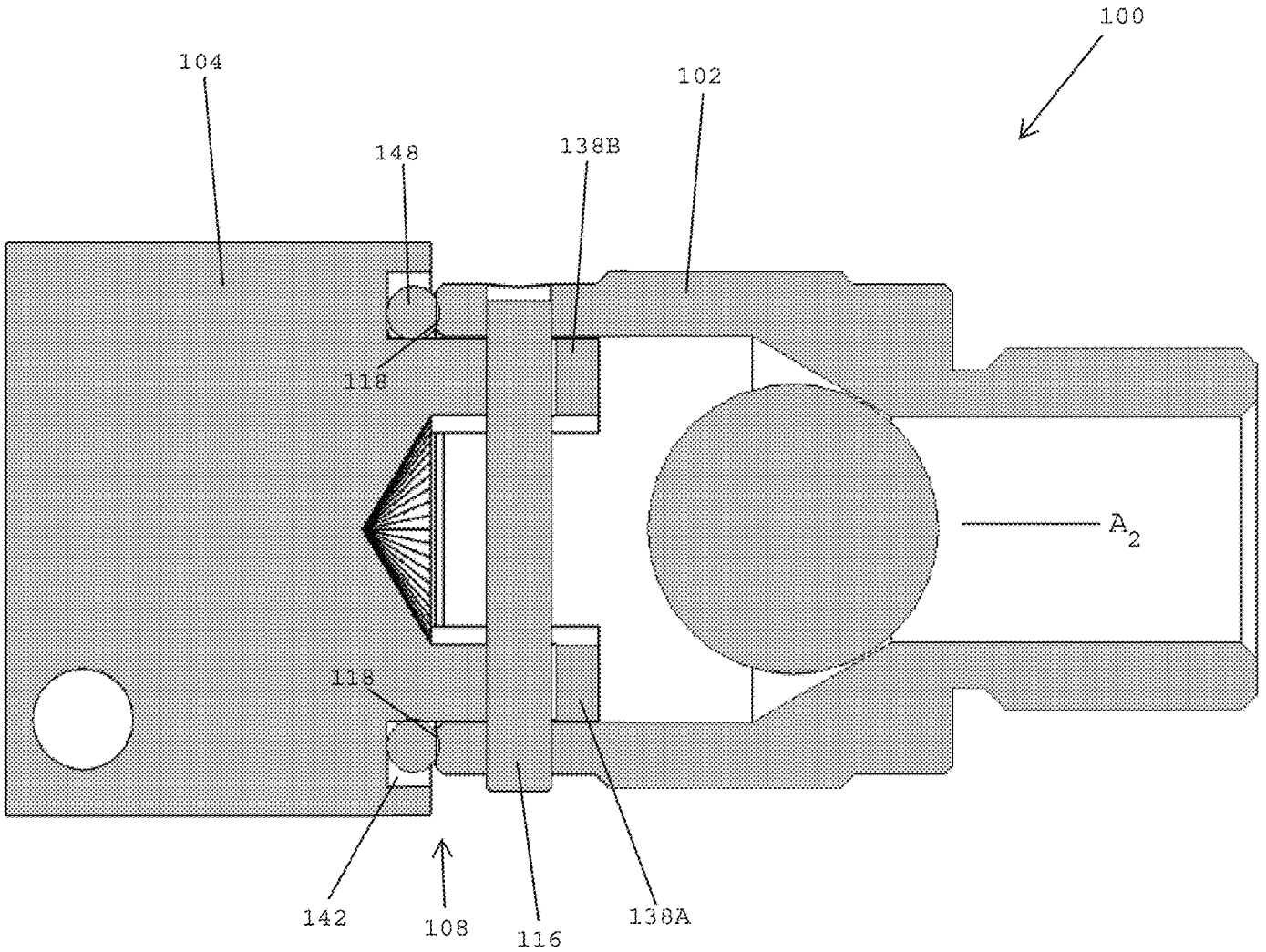
FIG. 11 is a cross-sectional view of a fail-safe sealing system for a watercraft including a self-bailing drain plug having a ball check valve and a sealing cap secured to a proximal end of the self-bailing drain plug, in accordance with one embodiment of the present patent application.

Referring to FIG. 11, in one embodiment, the sealing cap 104 of the fail-safe sealing system 100 is preferably secured to the proximal end 108 of the self-bailing drain plug 102 by inserting the first and second locking tabs 138A, 138B into the water drainage opening 109 (FIG. 3) located at the proximal end 108 of the self-bailing drain plug 102. The ball retaining pin 116 is preferably captured within the locking slots 140A, 140B (FIG. 8) of the respective first and second locking tabs 138A, 138B. The sealing cap 104 is preferably rotated about the longitudinal axis $A_2$ of the self-bailing drain plug 102 until the ball retaining pin 116 abuts against the closed ends 146 (FIG. 9) of the respective locking tabs 138A, 138B. The offset opening 146 (FIG. 9) at the closed ends of the respective locking slots desirably enhances the locking forces that secure the sealing cap 104 to the proximal end of the self-bailing drain plug 102.

The sealing washer 148 disposed within the washer groove 142 preferably projects beyond the distal face 132 of the sealing cap base 128 for abutting against the proximal face 118 at the proximal end 108 of the self-bailing drain plug 102 to form a water-tight seal between the sealing cap base 128 of the sealing cap 104 and the proximal face 118 of the self-bailing drain plug 102. As the sealing cap 104 is rotated onto the ball retaining pin 116, the locking cap 104 is preferably pulled toward the distal end 110 of the self-bailing drain plug 102 for compressing the sealing washer 148 between the base of the washer groove 142 and the proximal face 118 (FIG. 3) of the self-bailing drain plug 102.

Figure 12:
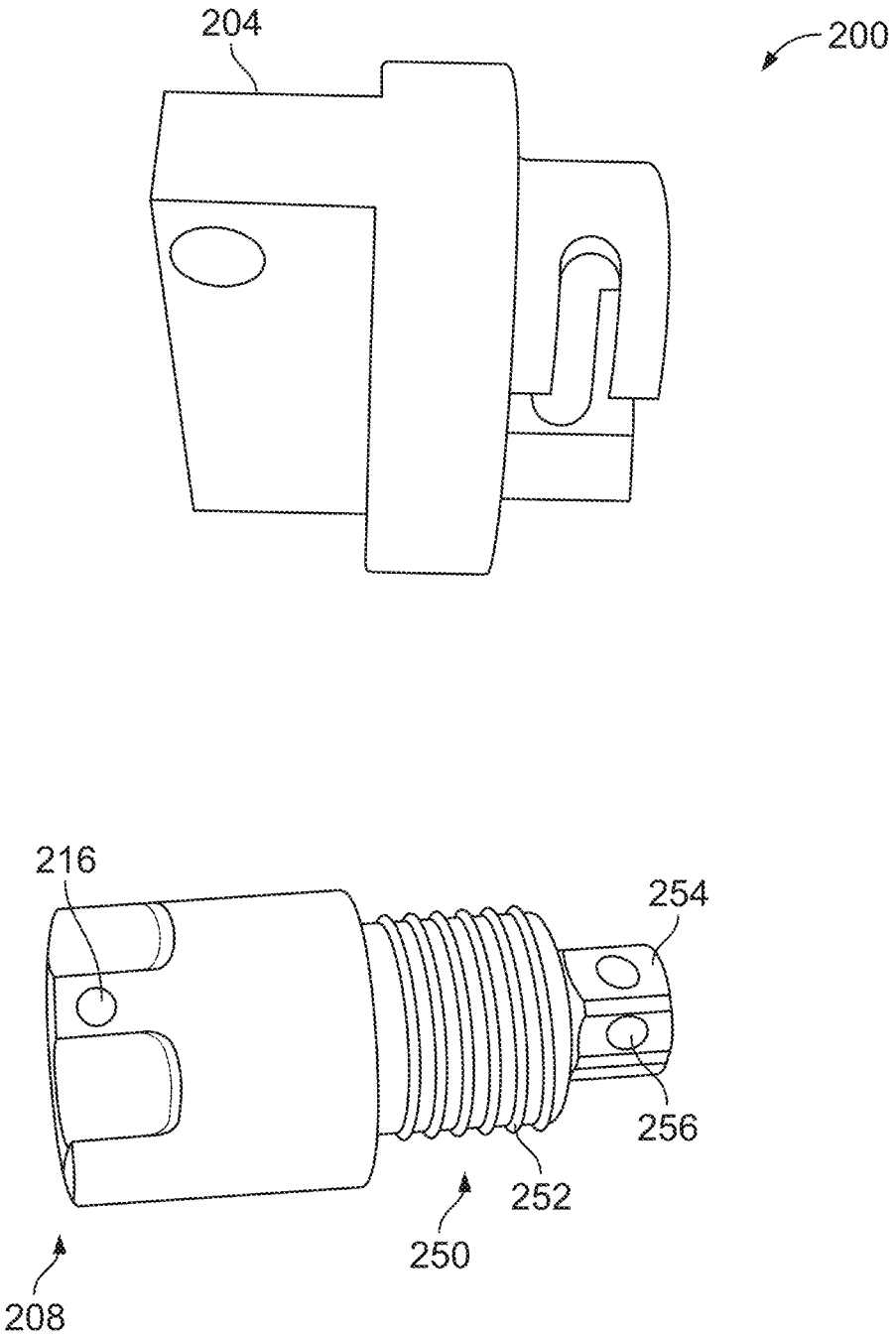
FIG. 12 is a perspective view of a fail-safe sealing system for a watercraft including a self-bailing drain plug having a ball check valve and a sealing cap that is configured for being secured to a proximal end of the self-bailing drain plug, in accordance with one embodiment of the present patent application.

Referring to FIG. 12, in one embodiment, a fail-safe sealing system 200 for a watercraft (e.g., a boat; a personal watercraft) preferably includes a self-bailing drain plug 202 and a sealing cap 204 that is adapted to be secured to a ball retaining pin 216 that extends across a drainage opening located at the proximal end 208 of the self-bailing drain plug 202.

In one embodiment, the distal end of the self-bailing drain plug 202 preferably includes an externally threaded projection 250 having external threads 252 that are adapted to mesh with internal threads of a water drainage hole of a boat or personal watercraft, or a flange that surrounds a water drainage hole of a vessel.

In one embodiment, when the externally threaded projection 250 is connected with a vessel, the proximal end 208 of the self-bailing drain plug 202 is preferably located outside the vessel (e.g., outboard).

In one embodiment, an elongated conduit preferably extends along the entire length of the self-bailing drain plug 102 for enabling water to pass through the self-bailing drain plug. In one embodiment, a strainer 254 is preferably secured to a distal opening adjacent the distal end of the self-bailing drain plug 202. The strainer 254 desirably includes drainage holes 256 spaced from one another about the outer perimeter of the strainer 254. Water is able to pass through the drainage holes 256 for draining the water from a vessel. The strainer 254 is preferably configured to prevent sticks, pine needles, debris, etc. that may be present in water (e.g., bilge water) from clogging the self-bailing drain plug 202.

Figure 13A:
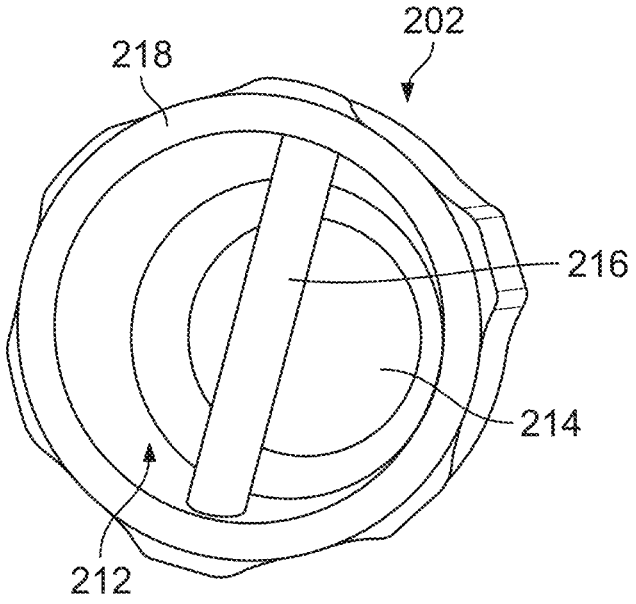
FIG. 13A is a proximal end view of the self-bailing drain plug shown in FIG. 12, the self-bailing drain plug including a ball retaining pin adjacent an opening at the proximal end of the self-bailing drain plug.
Figure 13B:
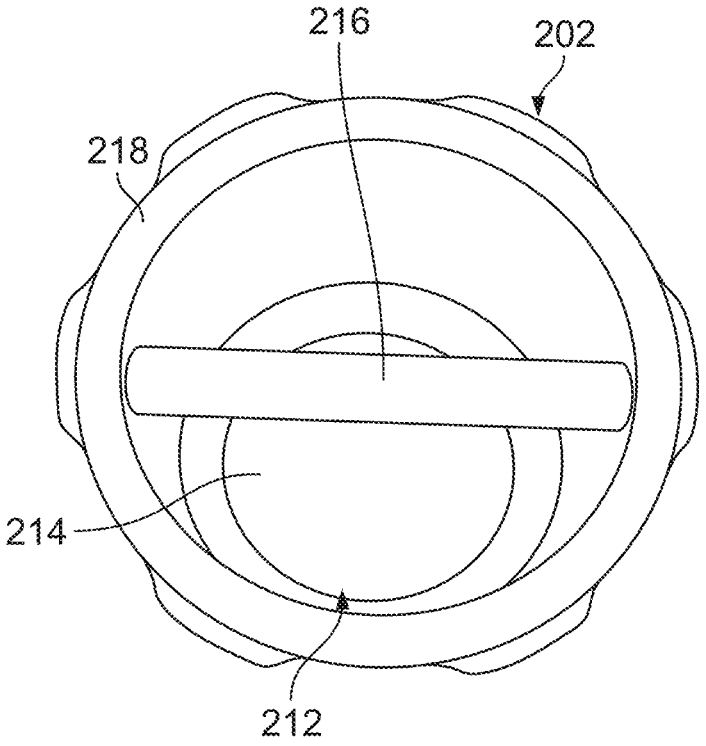
FIG. 13B is another proximal end view of the self-bailing drain plug shown in FIG. 12.

Referring to FIGS. 13A and 13B, in one embodiment, the self-bailing drain plug 202 preferably has a proximal face 218 that extends around an outer perimeter of the self-bailing drain plug at the proximal end thereof. The self-bailing drain plug 202 preferably has an elongated conduit 212 that extends from the proximal end to the distal end thereof for enabling water to pass therethrough.

The self-bailing drain plug 202 preferably includes a ball retaining pin 216 that is configured to retain a ball 214 (e.g., a ball made of an acetal homopolymer) within the self-bailing drain plug 202 when the ball 214 moves into an open position for enabling water to be drained from a boat or a personal watercraft.

Figure 14:
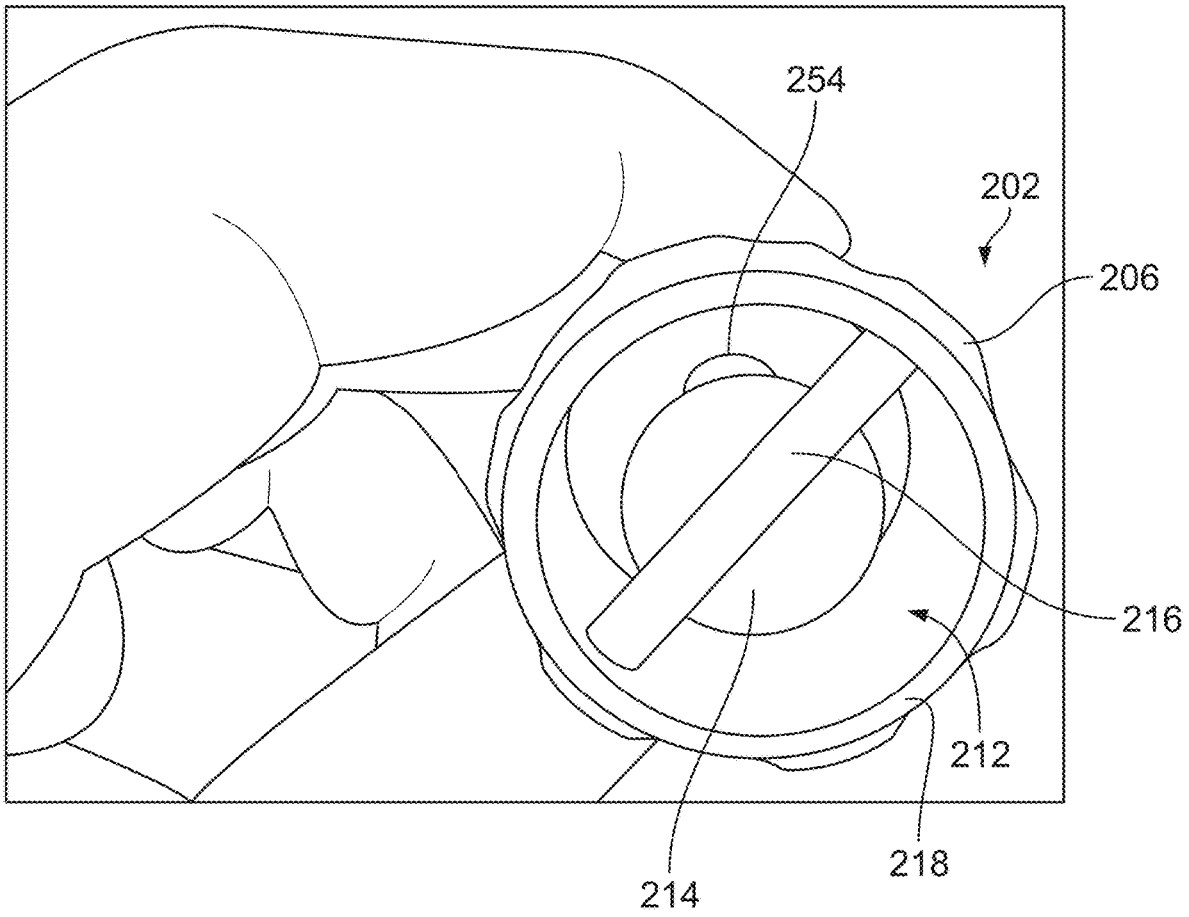
FIG. 14 shows the self-bailing drain plug of FIGS. 12 and 13A-13B with the ball a ball retaining pin, in accordance with one embodiment of the present patent application.

Referring to FIG. 14, when the ball 214 of the self-bailing drain plug 202 is in the open position for enabling water to be drained from the boat or personal watercraft, the ball retaining pin 216 that extends across the drainage opening retains the ball within the proximal end of the self-bailing drain plug. The outer perimeter of the ball 214 is preferably spaced away from the inner surface of the outer wall 206 of the self-bailing drain plug 202 for providing a flow area for the water to flow around the ball 214 for being drained from the watercraft. The strainer 254 (FIG. 12) covers the opening at the distal end of the conduit 212 that extends along the length of the self-bailing drain plug 202.

Figure 15A:
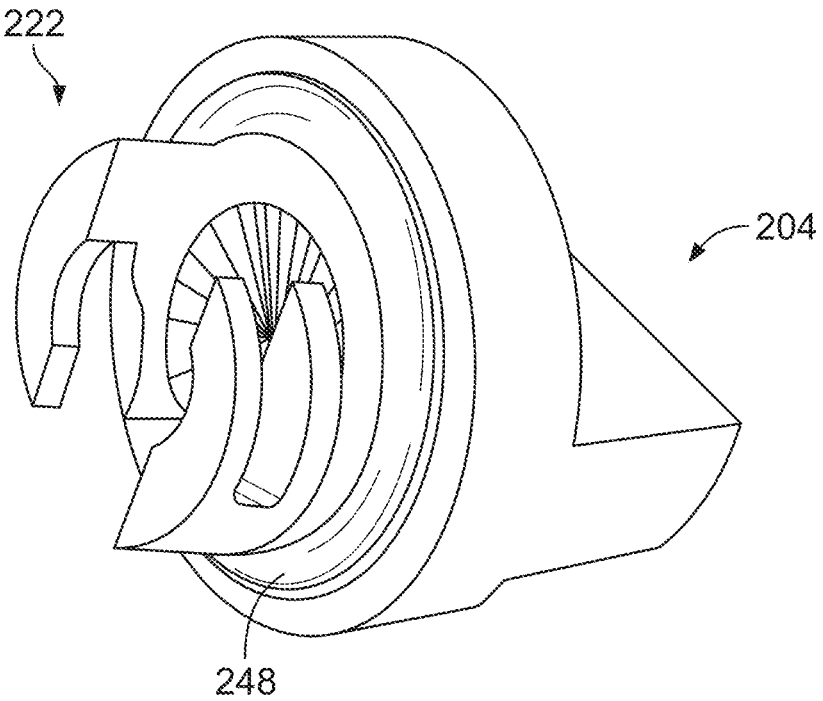
FIG. 15A is a perspective view of a distal end of the sealing cap shown in FIG. 12 including a sealing washer disposed within a sealing groove formed in a distal face of an annular base of the sealing cap, in accordance with one embodiment of the present patent application.
Figure 15B:
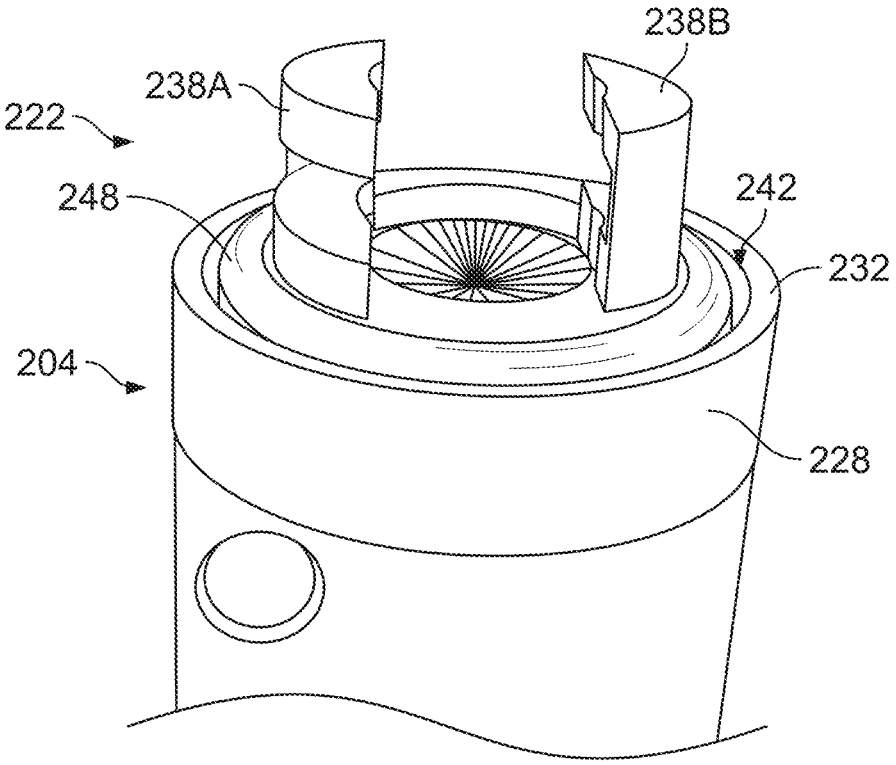
FIG. 15B is another perspective view of the distal end of the sealing cap and the sealing washer shown in FIG. 15A.

Referring to FIGS. 15A and 15B, in one embodiment, the sealing cap 204 preferably includes the bayonet-style locking assembly 222 as shown and described above in FIGS. 7A and 7B. The sealing cap base 228 preferably includes a distal face 232 having a washer groove 242 formed therein. The sealing washer 248 is preferably inserted into the washer groove 242 and surrounds the first and second locking tabs 238A, 238B of the sealing cap 204. The sealing washer 248 preferably projects distally beyond the distal face 232 of the sealing cap base 228, thereby forming a water-tight seal with the proximal face 218 (FIG. 14) of the self-bailing drain plug 202.

Figure 16:
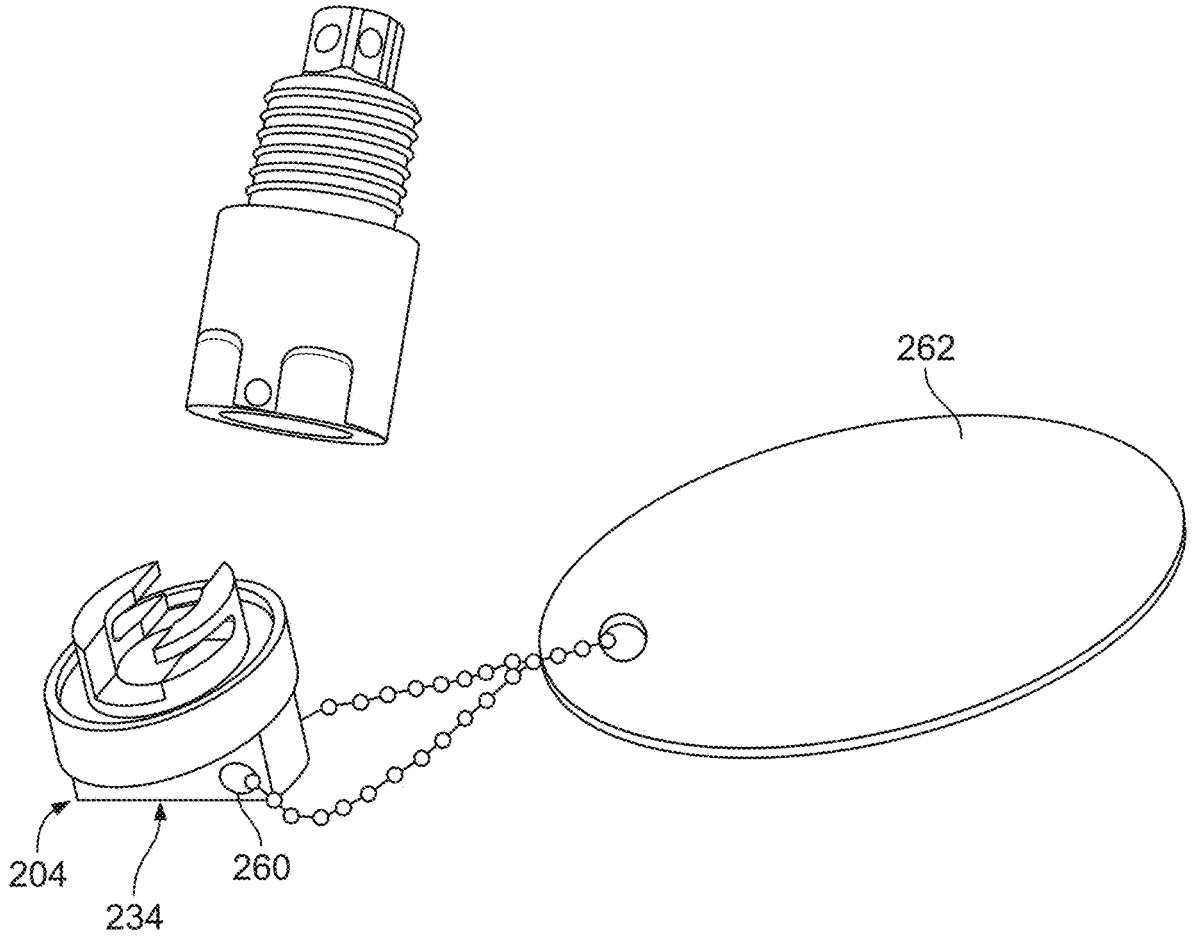
FIG. 16 shows a fail-safe sealing system including the self-bailing drain plug and the sealing cap of FIG. 12, and a flotation device secured to the sealing cap, in accordance with one embodiment of the present patent application.

Referring to FIG. 16, in one embodiment, the sealing cap 204 preferably includes the handle 234 having an opening 260 formed therein that is configured for coupling a flotation device 262 to the sealing cap 204. In one embodiment, the flotation device 262 preferably floats the sealing cap 204 on water if the sealing cap is dropped into the water. The flotation device 262 will preferably enable an operator of a watercraft to retrieve the sealing cap 204 so that it does not sink to the bottom of the water.

Figure 17:
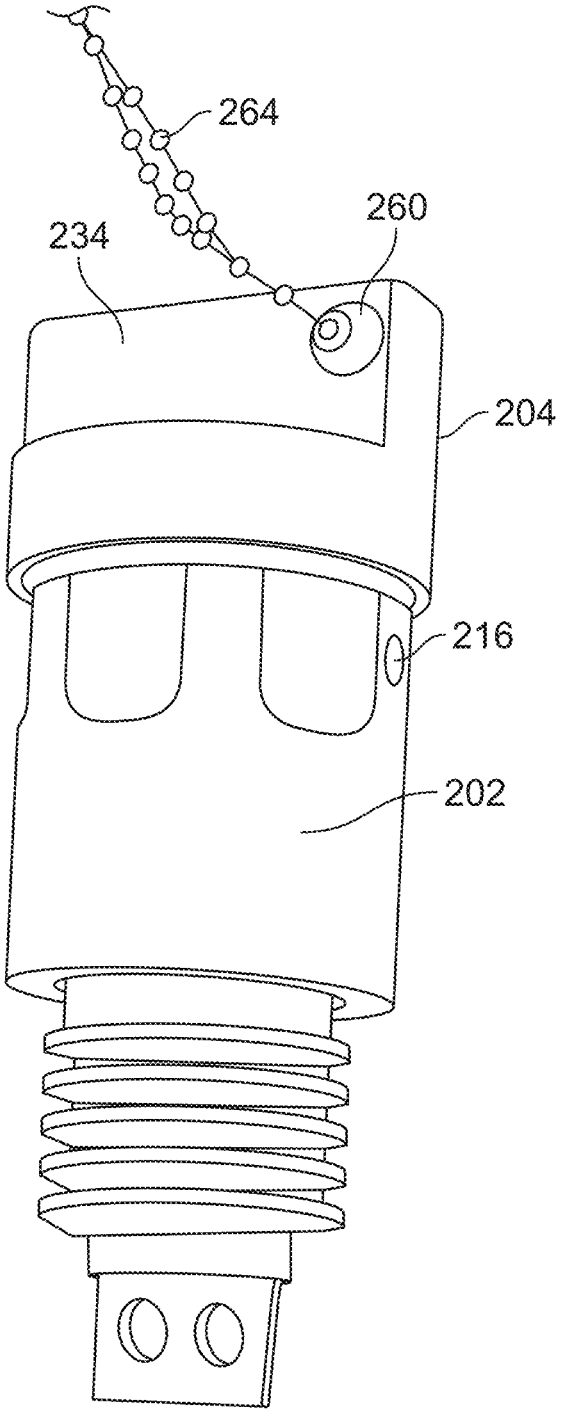
FIG. 17 is a perspective view of the fail-safe sealing system of FIG. 16 after the sealing cap has been locked onto a ball retaining pin located adjacent the proximal end of the self-bailing drain plug, in accordance with one embodiment of the present patent application.

Referring to FIG. 17, in one embodiment, the sealing cap 204 is preferably secured to the proximal end of the self-bailing drain plug 202 using the bayonet-style locking assembly disclosed herein. The first and second locking tabs of the sealing cap 202 preferably engage the ball retaining pin 216 for locking the sealing cap 204 to the self-bailing drain plug 202. The handle 234 of the sealing cap 202 has the opening 260 formed therein, which is adapted to be connected with a chain 264 of the flotation device 262 (FIG. 16).

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A fail-safe sealing system for a watercraft comprising:

a self-bailing drain plug having an outer wall with a proximal end having a proximal opening, a distal end having a distal opening, and a fluid conduit that extends from the proximal opening to the distal opening;

a check valve including a ball disposed within said fluid conduit and being surrounded by said outer wall;

a ball retaining pin extending between opposite lateral sides of said outer wall adjacent said proximal opening for preventing said ball from passing through said proximal opening;

a sealing cap having a bayonet-style locking assembly that locks onto said ball retaining pin for securing said sealing cap to the proximal end of said outer wall for forming a water-tight seal with the proximal end of said outer wall of said self-bailing drain plug, said sealing cap further comprising a flotation device secured thereto;

wherein said sealing cap comprises:

a sealing cap base having a proximal face and a distal face;

a handle projecting from the proximal face of said sealing cap base;

washer groove formed in the distal face of said sealing cap base;

a sealing washer disposed within said washer groove, said sealing washer having a thickness that is greater than depth of said washer groove so that a portion of said sealing washer extends distally beyond the distal face of said sealing cap base;

wherein said handle comprises an opening, and wherein said flotation device is secured to said handle via the opening in said handle.

2. The fail-safe sealing system as claimed in claim 1, wherein the proximal end of said outer wall has a proximal face that surrounds the proximal opening, and wherein said sealing cap has a sealing washer projecting from a washer groove formed therein that is configured to engage said proximal face for forming the water-tight seal with the proximal end of said outer wall.

3. The fail-safe sealing system as claimed in claim 1, wherein the distal end of said outer wall of said self-bailing drain plug includes external threads that are configured to mesh with internal threads of a drain hole of a watercraft.

4. The fail-safe sealing system as claimed in claim 1, wherein said fluid conduit has a smaller diameter section adjacent the distal end of said outer wall that defines a ball seating surface that is adapted to engage an outer surface of said ball.

5. The fail-safe sealing system as claimed in claim 1, further comprising a strainer covering said distal opening of said self-bailing drain plug.

6. System as The fail-safe sealing claimed in claim 1, wherein said ball retaining pin comprises stainless steel and said ball is made of an acetal homopolymer.

7. The fail-safe sealing system as claimed in claim 1, wherein said bayonet-style locking assembly comprises:

first and second locking tabs projecting distally from said sealing cap base and distally beyond the distal face of said sealing cap base;

each said locking tab including a locking slot that is configured to receive said ball retaining pin for securing said sealing cap to the proximal end of said self-bailing drain plug.

8. The fail-safe sealing system as claimed in claim 7, wherein each said locking slot has an open end and a closed end, wherein said ball retaining pin is configured for being captured within the open ends of said respective locking slots of said first and second locking tabs.

9. The fail-safe sealing system as claimed in claim 8, wherein said sealing cap is rotatable relative to a longitudinal axis of said self-bailing drain plug for securing said sealing cap to the proximal end of said self-bailing drain plug.

10. The fail-safe sealing system as claimed in claim 9, wherein during initial rotation of said sealing cap said ball retaining pin is located at the open ends of said respective locking slots and during a later rotation of said sealing cap said ball retaining pin is located at the closed ends of said respective locking slots.

11. The fail-safe sealing system as claimed in claim 10, wherein said ball retaining pin has an outer diameter and said locking slots have a height that is less than the outer diameter of said ball retaining pin.

12. The fail-safe sealing system as claimed in claim 10, wherein the open ends of said locking slots of said first and second locking tabs face in opposite directions for enabling said sealing cap to be twisted as it is secured to the proximal end of said self-bailing drain plug.

13. A fail-safe sealing system for a watercraft comprising:

a self-bailing drain plug having an outer wall with a proximal end having a proximal opening, a distal end having a distal opening, and a fluid conduit that extends from the proximal opening to the distal opening;

a ball disposed within said fluid conduit;

a ball retaining member configured to prevent said ball from passing through said proximal opening;

a sealing cap configured to lock onto said ball retaining member for securing said sealing cap to the proximal end of said outer wall for forming a water-tight seal with the proximal end of said outer wall of said self-bailing drain plug, said sealing cap further comprising:

a flotation device secured thereto;

a sealing cap base having proximal face and a distal face;

a handle projecting from the proximal face of said sealing cap base;

a washer groove formed in the distal face of said sealing cap base;

a sealing washer disposed within said washer groove, said sealing washer having a thickness that is greater than a depth of said washer groove so that a portion of said sealing washer extends distally beyond the distal face of said sealing cap base;

wherein said handle comprises an opening, and wherein said flotation device is secured to said handle via the opening in said handle.

14. The fail-safe sealing system for a watercraft of claim 13, wherein the distal end of said outer wall of said self-bailing drain plug includes external threads that are configured to mesh with internal threads of a drain hole of a watercraft.

15. The fail-safe sealing system as claimed in claim 13, wherein said fluid conduit has a smaller diameter section adjacent the distal end of said outer wall that defines a ball seating surface that is adapted to engage an outer surface of said ball.

16. The fail-safe sealing system as claimed in claim 13, further comprising a strainer covering said distal opening of said self-bailing drain plug.

17. A fail-safe sealing system for a watercraft comprising:

a self-bailing drain plug having an outer wall with a proximal end having a proximal opening, a distal end having a distal opening, and a fluid conduit that extends from the proximal opening to the distal opening, said distal opening having a smaller area than said proximal opening;

a ball disposed within said fluid conduit;

a ball retaining member adapted to prevent said ball from passing through said proximal opening;

said outer wall having external threads that are configured to mesh with internal threads of a drain hole of a watercraft;

a sealing cap fixable on said proximal end, said sealing cap further comprising:

a flotation device secured thereto;

a sealing cap base having a proximal face and a distal face;

handle projecting from the proximal face of said sealing cap base;

washer groove formed in the distal face of said sealing cap base;

sealing washer disposed within said washer groove, said sealing washer having a thickness that is greater than a depth of said washer groove so that a portion of said sealing washer extends distally beyond the distal face said sealing cap base;

wherein said handle comprises an opening, and wherein said flotation device is secured to said handle via the opening in said handle.

18. The fail-safe sealing system as claimed in claim 17, further comprising a strainer.

* * * * *